United States Patent [19]

Moran et al.

[11] 4,398,849

[45] Aug. 16, 1983

[54] PORTABLE DOCK

[75] Inventors: James S. Moran; Marlo W. Groezinger, both of Freeport, Ill.

[73] Assignee: Highland Agro Inc., Pearl City, Ill.

[21] Appl. No.: 334,432

[22] Filed: Dec. 24, 1981

[51] Int. Cl.[3] ..... E02B 3/20

[52] U.S. Cl. ..... 405/221; 114/267; 16/267; 403/100; 405/218

[58] Field of Search ..... 405/221, 218, 219, 220; 403/100, 101, 102; 16/267, 268; 52/71

[56] References Cited

U.S. PATENT DOCUMENTS

| | | | |
|---|---|---|---|
| 1,243,950 | 10/1917 | Kenniker | 16/267 |
| 2,618,214 | 11/1952 | Holsten . | |
| 2,948,121 | 8/1960 | Karst . | |
| 3,345,825 | 10/1967 | Parker . | |
| 3,421,327 | 1/1969 | Donaldson . | |
| 3,686,876 | 8/1972 | Muschell . | |
| 4,037,420 | 7/1977 | Wicks . | |
| 4,107,932 | 8/1978 | Cantrell . | |
| 4,123,912 | 11/1978 | Meldrum . | |
| 4,174,187 | 11/1979 | Parisien | 405/221 |
| 4,260,293 | 4/1981 | Peterson | 405/221 |

FOREIGN PATENT DOCUMENTS

| | | | |
|---|---|---|---|
| 647768 | 9/1962 | Canada | 405/221 |

*Primary Examiner*—Dennis L. Taylor
*Assistant Examiner*—J. Gungor
*Attorney, Agent, or Firm*—Hill, Van Santen, Steadman & Simpson

[57] ABSTRACT

A portable dock and dock sections used therewith, characterized by each of the dock sections have a plurality of frame members forming a rectangular deck frame for supporting a deck assembly, a pair of adjustable legs extending from adjacent one end of the rectangular deck frame and a first coupling unit disposed on a frame member at the other end of the deck frame. Preferably, an additional or second coupling unit, which is adapted to cooperate with a first coupling unit, is arranged either on an end or side frame member or both at the one end to enable connecting sections together to form either a straight line pier or a pier with a "T" or "L" shape. The portable dock also includes an anchor section having an anchor member with a similar coupling unit which coact with the first coupling unit of a first dock section for securing the first dock section to the beach or shoreline.

11 Claims, 10 Drawing Figures

FIG.1
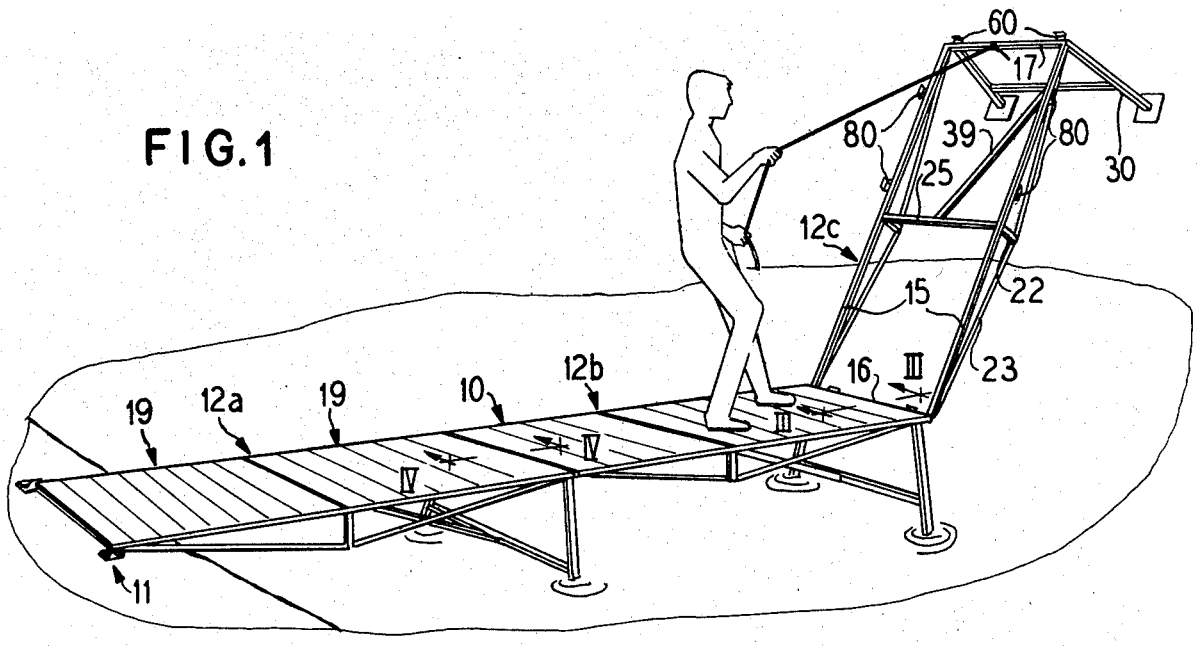
FIG. 2
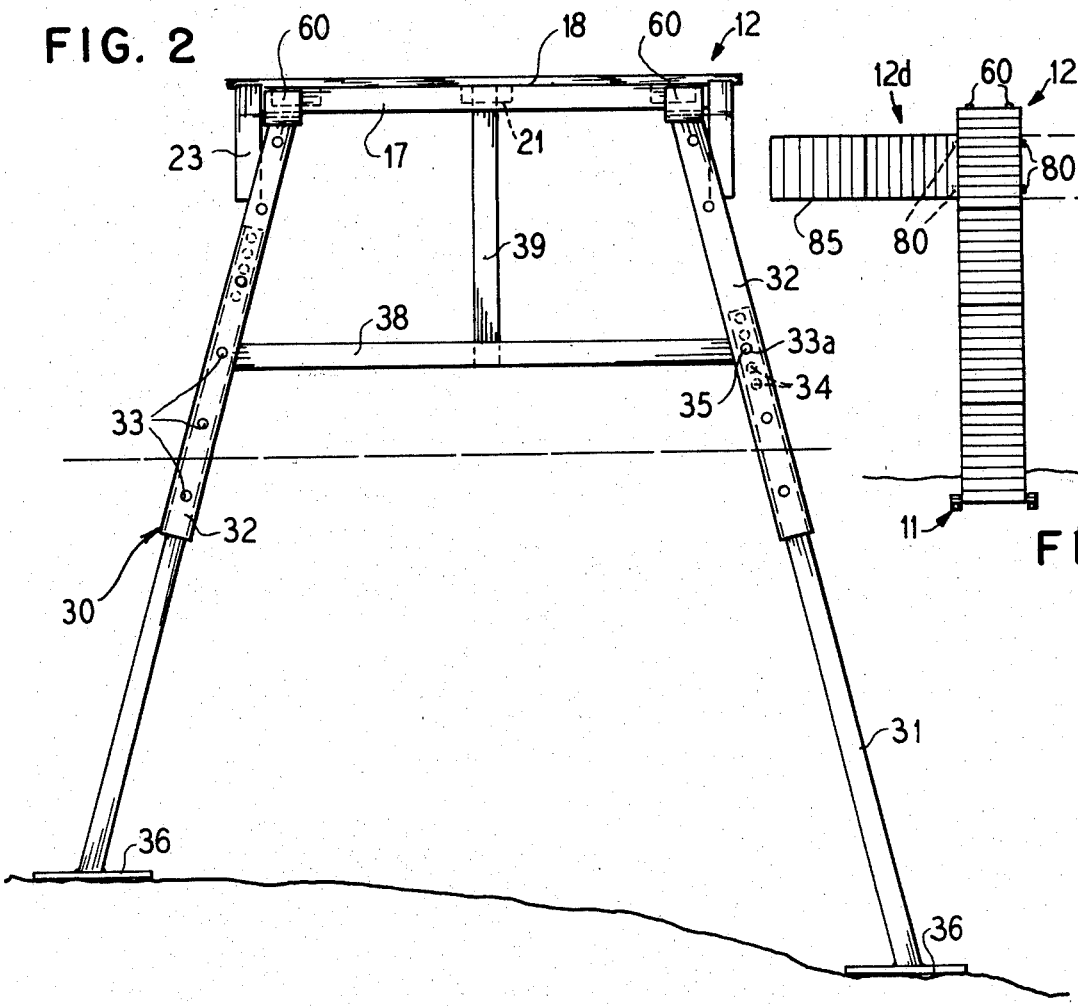
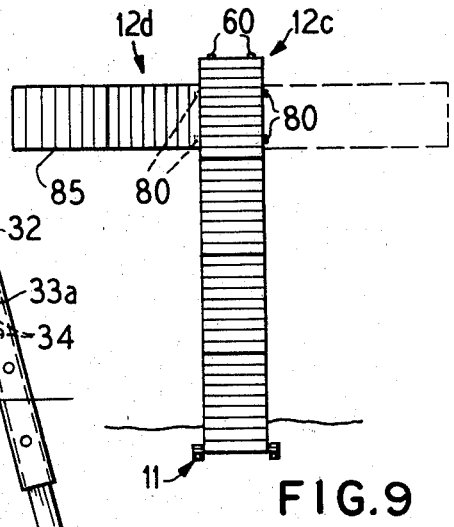
FIG.9

PORTABLE DOCK

BACKGROUND OF THE INVENTION

The present invention is directed to a portable dock and a dock section utilized therein to provide a portable boat pier which can be easily installed and removed by a single person without entering the water. The portable dock or boat pier utilizes an anchor section on which a dock section is detachably connected and then additional dock sections are attached to the first applied dock section to obtain the desired pier configuration.

It has been suggested to form a portable landing dock by utilizing sections which are interconnected together. Each of these sections will include adjustable legs and involves a pivoting hinge-type connection. Two examples of known devices are disclosed in U.S. Pat. No. 2,618,124, and U.S. Pat. No. 3,421,327. Problems exist with these known devices because of their weight, which makes it difficult for a single person to attempt to assemble the dock, and because the hinge connection is difficult to form during the assembly step.

SUMMARY OF THE INVENTION

The present invention is directed to providing an economical, light-weight boat pier or dock structure, which is formed of simple, reliable, and effective subassemblies which are interconnectable with one another and which provide a simple, rugged structure which is easily assembled and disassembled by a single person without getting into the water.

To accomplish this, the present invention is directed to a dock section for a portable dock, which is composed of an anchor section and at least one dock section detachably interconnected to each other to form a pier, each dock section comprises a rectangular deck frame having a pair of side frame members, a first end frame member and a second end frame member to form a supporting surface for a removable deck assembly, a pair of leg members secured to the deck frame adjacent to the second end frame member, first coupling means being provided at the first end frame member for connecting the first end frame member to another section and a second coupling means being provided on at least one of the frame members of the pair of side frames and the second end frame member to enable forming an interlocking connection between a first coupling means of another section, each of the first and second coupling means being formed by a pair of strap members, each strap member having a first portion extending from a bottom of the frame member approximately in a plane parallel to the supporting surface of the deck frame for a distance slightly greater than the cross-sectional dimension of the frame member and terminating in an upwardly extending second portion forming substantially a right angle with the first portion, said pair of strap members of the first coupling means having a different spacing therebetween than the pair of strap members of the second coupling means so that one of the pairs is received between the other pair when forming an interlocking connection with each pair engaging the frame member associated with the other pair.

The portable dock, according to present invention, in its simpliest form includes an anchor section and at least one of the above mentioned dock sections. The anchor section will have an anchor member having anchoring means disposed at each end and the dock section and the anchor member each have a pair of strap elements with a first portion extending outwardly therefrom beneath the other member and terminating in a second portion upstanding at right angles to the first portion to interlockingly connect the anchor section to the first end frame member of the dock section and a decking assembly is disposed on the rectangular deck frame. If additional sections are added, each of the additional dock sections is the same as the first mentioned dock section and is secured by having the strap elements adjacent to the first end frame member being connected or engaged with the strap members or elements at the second frame member to form an interlocking connection between the two sections. If desired, additional sections can be added and instead of being added so that the sections lie in a straight line, can form either an "L" or "T" shape if the second coupling means is positioned on one of the side frame members either instead of on the second end frame member or in addition thereto.

Preferably, each of the dock sections has the frame members formed of rectangular tubes and the strap members are secured to the bottom surface of the rectangular or square tube. Preferably, the strap members, particularly those forming the second coupling means at the second end frame member, are wider than the cross-sectional dimensions of the rectangular or square tube and form a welding base on which the legs are secured. The legs are preferrably adjustable legs which have a first leg portion telescopically received in a second leg portion, and means for enabling adjusting the length of the first leg portion received in the second leg portion to vary the length of the leg. This means includes the second leg portion having a series of holes spaced therealong and the first leg portion having a group of closely spaced holes which are aligned with one of the holes in the series in the second leg portion which aligned holes receive a pin to provide the desired length.

Preferably, each of the strap members has the first portion extending downward at a slight angle to the plane of the bottom surface of the frame member, so that an interlocking connection will allow at least one of the sections to slope from the horizontal at a small angle. In other words, the plane of the two interconnected sections can form an angle with each other which is slightly greater than 180°.

Each of the deck frame preferrably includes reinforcing arrangement comprising a vertical member extending downward from the center of each side frame member and a stringer member, which is secured to the end of the vertical member and extends to each end of the side frame member to overlap the ends to close the end of the tube forming the side frame member. Due to the configuration of the reinforcing arrangement, if the second coupling means is disposed on the side frame member, it is spaced inwardly from the second end frame member so that the side frame member of a deck section, which is connected thereto, is substantially aligned with the vertical member. This inward spacing also provides the necessary clearance for the strap members to move during assembly and disassembly operations without becoming caught on the stringer member.

BRIEF DESCRIPTION OF THE DRAWINGS

FIG. 1 is a perspective view of a portable dock according to the present invention during installation or removal;

FIG. 2 is an end view of a dock section in accordance with the present invention;

FIG. 9 is a plan view showing variations of the configuration of the dock of the present invention.

DESCRIPTION OF THE PREFERRED EMBODIMENTS

The principles of the present invention are particularly useful when incorporated in a portable dock generally indicated at 10 in FIG. 1. The portable dock 10 enables forming a boat pier or a pier for recreational water craft. As illustrated, the portable dock 10 is composed of an anchor section generally indicated at 11 and a plurality of substantially identical dock sections generally indicated at 12*a*, 12*b* and 12*c*.

Figure 3:
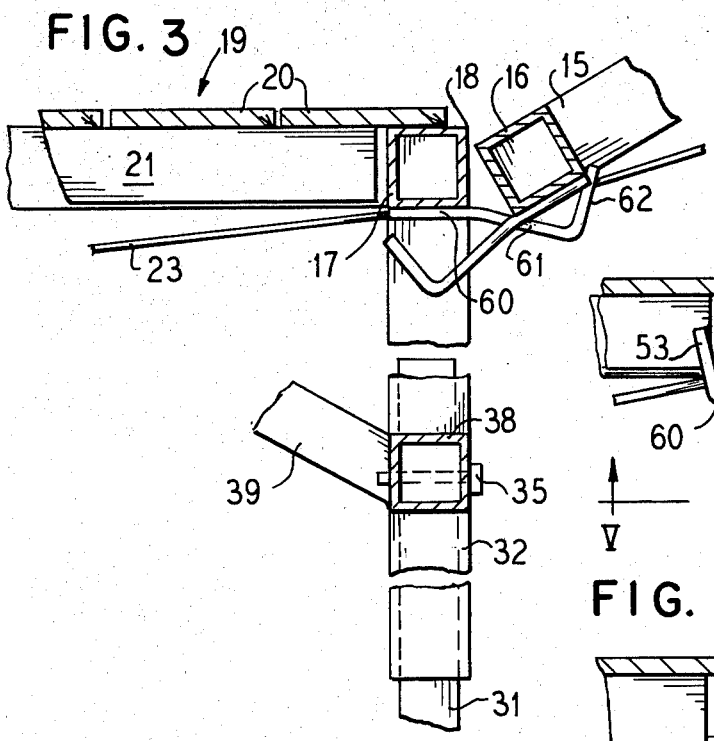
FIG. 3 is a partial cross-sectional view taken along lines III—III of FIG. 1.

As best illustrated in FIGS. 1 and 2, each of the dock sections 12*a*, 12*b* and 12*c* comprises a deck frame, which is formed by a pair of side frame members or elements 15, a first end frame member 16 and a second end frame member 17. These frame members or elements are illustrated as being formed out of rectangular tubes with a square cross-section and the upper surfaces of the members 15, 16, and 17 form a plane 18, such as is illustrated in FIG. 3 for receiving a pair of deck assemblies generally indicated at 19. Each deck assembly covers one-half of the deck frame and is composed of a plurality of parallel extending planks 20 which are interconnected by 3 cross-members 21 and rest on the plane 18 of the deck frame. The 2 cross-members 21 are spaced apart so that the outer edge 21*a* (FIG. 5) is near or engages an inner side 15*a* of the side frame member 15 to prevent or limit movement of the assembly 19 in the deck frame. The center cross members 21 has a length so that it is received between a cross member 25 and the respective end member and prevent movement along the side frame member 15. The 2 outer cross members, have a length to provide clearance for the placement of hinge members 50 and 60.

Figure 6:
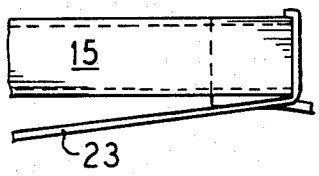
FIG. 6 is an enlarged partial side view adjacent to an end of the section.

As illustrated, each of the side frame members 15 of the deck frame have a reinforcing arrangement, which is formed by a vertical extending member 22, which is positioned at the center point or mid-point of the side frame members 15 and extends downward and a stringer 23, which is a flat strip connected to the end of the member 22 and to each end of the side members 15. As best illustrated in FIG. 6, each end of the strip 23 is wrapped around the tube forming the side frame member 15 to close the tube. In addition, the deck frame includes a cross member 25 (FIG. 1).

As best illustrated in FIGS. 1 and 2, each of the dock sections 12 includes a pair of adjustable legs 30. Each of the legs 30 is formed of a first portion 31, which is telescopically received in a second portion 32. To enable adjusting the length of the leg 30 to different lengths as illustrated in FIG. 2, the second portion 32 has a plurality of holes or openings 33 which are spaced therealong. The first portion has a group of approximately five (5) closely spaced holes 34 which are aligned with one of the holes 33 such as the hole 33*a* so that a pin 35 (best illustrated in FIG. 3) may be entered to form an adjustable connection therebetween. Each of the first portions 31 terminates in a flat anchor plate or foot such as 36. It is noted that to improve stability, each of the legs 30 is mounted to extend outwardly at an angle of approximately 15° to a vertical but are in the same plane which is formed by the second end frame member 17 and a cross member 38, which interconnect portions 32. To provide rigidity in a direction extending parallel to the side frame members 15, a center support element 39 extends from the cross member 38 to the cross member 25, which interconnects the center points of the side frame members 15.

Figure 4:
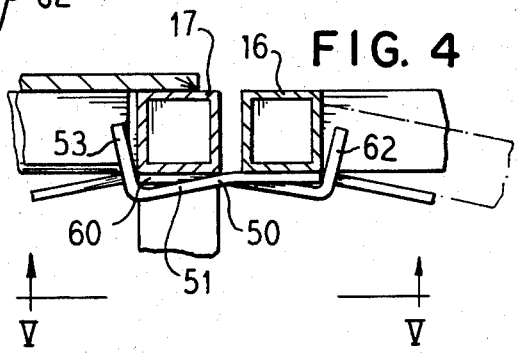
FIG. 4 is a partial cross-sectional view along lines IV—IV of FIG. 1.
Figure 5:
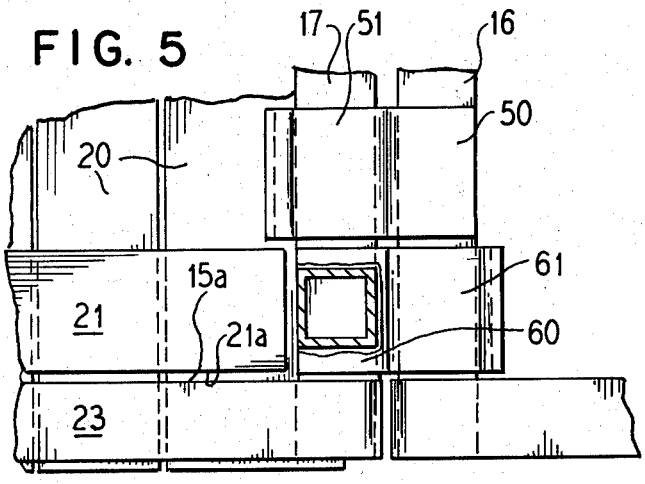
FIG. 5 is a partial plan view taken along lines V—V of FIG. 4.
Figure 8:
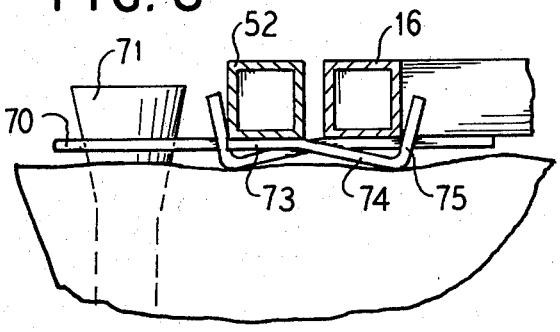
FIG. 8 is a cross-sectional view taken along the lines VIII—VIII of FIG. 7.
Figure 7:
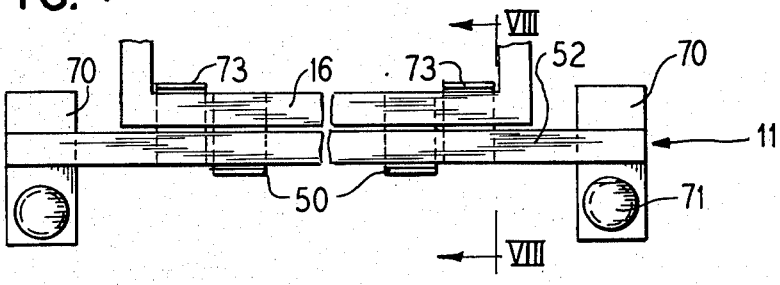
FIG. 7 is a plan view of the anchor section of the portable dock.

To interconnect a pair of dock section 12 together or to connect the first of the dock sections 12*a* to the anchor section 11, an interlocking connection is provided. As best illustrated in FIGS. 3, 4 and 5, the interlocking connection is formed by a first coupling means which includes a pair of strap members or elements 50, which are connected to a bottom surface of the first end frame member 16 and have a first portion 51 which extends therefrom preferably in a plane forming an angle of about 10° with the plane 18. The portion 51 has a length which will allow receiving either the second frame member 17 or an anchor member 52 of the anchor section 11. The portion 51 terminates in an upstanding portion 53 which forms substantially a right angle with the portion 51. In a similar manner, the second end frame member 17 has second coupling means which is formed by a pair of strap member or elements 60, which also have a portion 61 which extends at an angle of about 10° to the plane 18 for a length that is slightly greater than the dimensions of the frame member 16 and terminates in an upstanding portion 62 which forms a right angle therewith. As illustrated, the strap members 50 are spaced closer together than the strap members 60 so that when the two coupling means are assembled as illustrated in FIG. 5 they will prevent lateral movement along the direction of the end frame members such as 16 and 17.

Figure 3A:
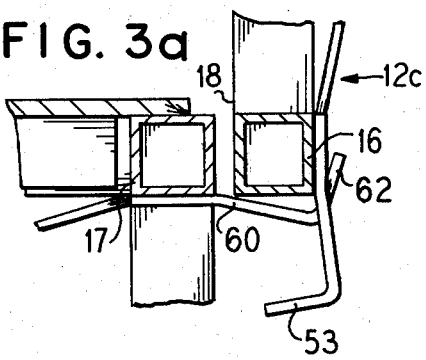
FIG. 3*a* is a partial cross-sectional view similar to FIG. 3 prior to a dock section being lowered to the position of FIG. 3.

To connect the two section together, the section being added such as the section 12*c* in FIG. 1, is positioned so that the plane 18 is substantially in a vertical plane as illustrated in FIG. 3*a*. In this position, the section 12*c* can be lowered with its portion 53 passing clear of the member 17 as the first end frame member 16 is received on the pair of strap members 60 of the second coupling means. Then by utilizing a rope such as is illustrated in FIG. 1 the dock section 12*c* is lowered from the vertical position. As illustrated, the strap members 50 are rotated from a vertically extending position to a position of FIG. 3 and eventually when the section is arranged with the feet 36 of its legs on the bottom of the body of water, the hook-like arrangement of the strap elements 50 and 60 will form an interlocking hinge arrangement illustrated in FIGS. 4 and 5. Due to the fact that each of the portions 51 and 61 lie in a plane forming an angle of about 10° with the plane of the surface 18, the deck sections can form an angle such as shown in broken lines in FIG. 4. If the plates 36 of the legs of the section 12*c* still do not touch bottom when the section is in a substantial horizontal position, then the section is raised and the legs are adjusted to increase their length. In FIG. 2, due to the contour of the bottom, each leg has a different length to compensate for changes in the contour of the bottom on which the two plates 36 rest.

The anchor section 11 and the first dock section 12*a* are connected in a similar manner. The anchor member 52 at each end has means such as plates 70 that has an opening for receiving stakes such as 71 to secure the anchor section 11 to the shore of the body of water. The anchor section 11 also has a pair of strap elements or members 73, which have the horizontal extending portion 74 and terminate in an upstanding portion 75 in a manner similar to the strap elements such as 50 or 60. The assembly of the first dock section 12*a* to the anchor section 11 is accomplished in the same manner as illustrated for the assembly of section 12*c* on 12*b*. It is noted that the strap elements 50 will slightly dig out the ground underneath the anchor element 52 to enable movement thereof. If the ground is too hard, some minor digging may be required before assemblying the section 12*a* on to the anchor section 11.

While the above description provides a pier which substantially extends along a straight line, other shapes such as a L-shaped pier, illustrated in FIG. 9, or a T-shaped pier, which is illustrated in FIG. 9 by broken lines, can be formed. In these instances, the deck sections, such as 12*c*, are provided with second coupling means on at least one of the side frame members 15 such as is shown by the strap elements 80 in FIG. 1. Utilizing the strap elements 80 of FIG. 1, an additional dock section, such as 12*d* can be coupled to the side frame member to form the L- or T-shaped pier. As noted, the pair of strap elements 80 are spaced inward from the second end member 17, so there is plenty of clearance for movement of the strap elements 50 of the section 12*d* being connected thereto without engaging or being hung up on the stringer 23. Due to this positioning, the side, such as 85 of the section 12*d*, will be substantially in line with the vertical member 22 and the cross support 25 or closely spaced therefrom. As illustrated in FIGS. 1 and 9, the section 12C actually has a second coupling means formed not only on the second end frame member 17, but also on each of the two side frame members 15.

Due to the rigid construction formed by utilizing rectangular tubing, each of the sections, are easily handled by a single worker during either assembly or disassembly of the portable dock 10. After each of the sections are in place, the two deck assemblies 19 are placed on the deck frame formed by the tubular frame members. As contemplated, this deck merely rests on the upper surface 18 of the deck frame and is divided into the two assemblies to reduce weight and allow easy handling. It should be noted that the dock is designed to be used primarily in small bodies of water which do not have a substantial amount of wave action or changes in their water level.

Due to the interlocking strap elements, which form the interlocking connection or joint, easy assembly can be obtained without the problems of attempting to pin two hinge portions together as in the prior art. Thus, the device can be easily assembled and disassembled when desired.

Although various minor modifications may be suggested by those who are versed in the art, it should be understood that we wish to embody within the scope of the patent granted hereon all such modifications as reasonably and properly come within the scope of our contribution to the art.

We claim:

1. A dock section for a portable dock composed of an anchor section and at least one dock section detachably interconnected to each other to form a pier, each dock section comprising a rectangular deck frame having a pair of side frame members, a first end frame member and a second end frame member to form a supporting surface for a removable deck assembly; a pair of leg members secured to the deck frame adjacent the second end frame member; first coupling means being provided at the first end frame member for connecting the first end frame member to another section and second coupling means on at least one of the frame members forming the pair side frame members and second end frame member to enable forming an interlocking connection with a first coupling means of another section, each of said first and second coupling means being formed by a pair of strap members, each strap member having a first portion extending from a bottom of the frame member in a plane approximately parallel to the supporting surface of the deck frame for a distance slightly greater than cross sectional dimensional of a frame member and terminating in an upwardly extending second portion forming substantially a right angle with the first portion, said pair of strap members of the first coupling means having a different spacing therebetween than the pair of strap members for the second coupling means so that one of the pairs is received between the other pairs when forming an interlocking connection with each pair engaging the frame member associated with the other pair.

2. A dock section according to claim 1, wherein the frame members are rectangular tubes and said strap members are secured to the bottom surface of the rectangular tubes.

3. A dock section according to claim 2, wherein said coupling means is on the second end frame member.

4. A dock section according to claim 3, wherein the strap members of the second coupling means are wider than the cross-sectional dimensions of the rectangular tubes, and said pair of legs are welded to said strap members forming the second coupling means which members act as welding bases for said legs.

5. A dock section according to claim 2, wherein the deck frame includes a reinforcing arrangement for each side frame member comprising a vertical member extending downward from the center of each side frame member and a stringer member secured to the end of said vertical member and extending to each end of the side frame member and overlapping the end to close the end of the tube.

6. A dock section according to claim 5, wherein the second coupling means is disposed on one of said side frame members spaced inwardly from the second end frame member so that a dock section connected thereto is spaced inward from the second end member.

7. A dock section according to claim 2, wherein the first portion of each strap member extends downward at a slight angle to the plane of the supporting surface so that the innerlocking connection allows at least one of the sections to slope from the horizontal at a small angle.

8. A dock section according to claim 2 wherein each of the legs is an adjustable leg having a first leg portion telescopically received in a second leg portion, and means for adjusting the length of said first leg portion received in the second leg portion to vary the length of said leg, said means includes the second leg portion having a series of holes spaced therealong, the first leg portion having a group of closely spaced holes and a pin being received in aligned holes of the portions.

9. A portable dock comprising an anchor section; at least one dock section; and means for interlockingly connecting the sections together; said anchor section comprising an anchor member having anchoring means disposed at each end; each dock section having a rectangular deck frame having a pair of side frame members and first and second end frame members, a pair of leg members secured to the deck frame adjacent the second end frame member and decking material being disposed on said rectangular deck frame; said means comprising said first end frame member and the anchor member of the anchor section each having a pair of strap elements with a first portion extending outwardly therefrom beneath the other member and terminating in a second portion upstanding at right angles to the first portion to interlockingly connect the anchor section to the first end frame member.

10. A portable dock according to claim 9 which further includes at least one additional dock section, said additional dock section including a rectangular deck frame having a pair of side frame members and first and second end frame membes, a pair of leg members secured to the deck frame adjacent to the second end frame member, said first end frame member being disposed adjacent to second end frame member of the first mentioned dock section, each of said second and first members having interlocking connecting means formed therebetween including a pair of strap members disposed on the first end frame member of the additional dock section and a pair of strap members on the second end frame member of the first dock section extending under the other end frame member and each terminating in an upstanding portion which interlocks said end frame members together while said deck frames are substantially in the same plane.

11. A portable dock according to claim 9, which includes at least three dock sections with two sections extending in a straight line and one section extending at a right angle thereto, each of said dock sections having a pair of strap members at the first end frame member and a second pair of strap members disposed on the second end frame member to enable interconnecting several of the dock sections to form a straight pier, one of said dock sections also including a pair of strap members being mounted on one of the side frame members inward from the second end frame member to form coupling means to enable attaching a dock section therefrom to extend laterally from said straight pier.

* * * * *